US008590521B2

(12) United States Patent
Tseng

(10) Patent No.: US 8,590,521 B2
(45) Date of Patent: Nov. 26, 2013

(54) PRESSURE STABILIZATION ARRANGEMENT FOR AIR PISTOL

(76) Inventor: Shu-Mei Tseng, New Taipei (TW)

( * ) Notice: Subject to any disclaimer, the term of this patent is extended or adjusted under 35 U.S.C. 154(b) by 104 days.

(21) Appl. No.: 13/447,272

(22) Filed: Apr. 15, 2012

(65) Prior Publication Data

US 2013/0269671 A1 Oct. 17, 2013

(51) Int. Cl.
*F41B 11/00* (2013.01)

(52) U.S. Cl.
USPC ..... 124/74; 124/66

(58) Field of Classification Search
USPC ..... 124/73–77, 66
See application file for complete search history.

(56) References Cited

U.S. PATENT DOCUMENTS 4,004,566 A * 1/1977 Fischer ..... 124/59
5,529,300 A * 6/1996 Frazier et al. ..... 463/47.4
5,845,629 A * 12/1998 Ratliff ..... 124/56
7,836,872 B2 * 11/2010 Tseng ..... 124/72
8,146,193 B1 * 4/2012 Franzino et al. ..... 15/3.5
8,485,173 B1 * 7/2013 Tseng ..... 124/73
2008/0216806 A1 * 9/2008 Tseng ..... 124/62
2011/0271941 A1 * 11/2011 Meggs ..... 124/65

* cited by examiner

*Primary Examiner* — Michael David

(57) ABSTRACT

An air pistol is provided with a hollow connector in a first chamber and releasably secured to a gas cartridge, the connector including an axial channel; a pressure stabilization assembly including a pressure stabilization chamber between the connector and the trigger, a spring biased cup in the first chamber, a sealing member on a bottom of the cup, and outlets between the sealing member and the connector; and a relief valve in a second chamber and including a passageway communicating the pressure stabilization chamber with one end of the second chamber, a spring biased plunger in the second chamber adjacent to the passageway, a blocking member fastened in the plunger and proximate to one end of the second chamber, a pressure adjustment screw at the other end of the second chamber, and an exit tunnel through the pressure adjustment screw to communicate with the second chamber.

1 Claim, 8 Drawing Sheets

PRESSURE STABILIZATION ARRANGEMENT FOR AIR PISTOL

BACKGROUND OF THE INVENTION

1. Field of the Invention

The invention relates to air guns and more particularly to an air pistol having a pressure stabilization arrangement for ensuring a reliable, safe pressurized air path.

2. Description of Related Art

Conventionally, an air pistol fires projectiles by means of compressed air or other gas, or compressed $CO_2$ all stored in a detachable, disposable cylinder (i.e., being not refillable). Such cylinders are intended for single use. And in turn, the use of disposable products had led to a marked increase in trash.

Thus, the need for improvement exists.

SUMMARY OF THE INVENTION

It is therefore one object of the invention to provide an air pistol comprising a trigger; a gas cartridge; a hollow connector disposed in a first chamber and releasably secured to the gas cartridge, the connector comprising an axial channel; a pressure stabilization assembly comprising a pressure stabilization chamber between the connector and the trigger, a spring biased cup disposed in the first chamber, a sealing member disposed on a bottom of the cup, and a plurality of outlets disposed between the sealing member and the connector; and a relief valve disposed in a second chamber spaced from the first chamber and comprising a passageway communicating the pressure stabilization chamber with one end of the second chamber, a spring biased plunger disposed in the second chamber adjacent to the passageway, a blocking member fastened in the plunger and proximate to one end of the second chamber, a pressure adjustment screw disposed at the other end of the second chamber, and an exit tunnel disposed through the pressure adjustment screw to communicate with the second chamber; wherein pressurized air in the gas cartridge having a pressure value no more than a predetermined maximum pressure of the gas cartridge flows to the pressure stabilization chamber via the channel of the connector, the outlets, and the first chamber; and wherein pressurized air in the pressure stabilization chamber having a pressure greater than a predetermined maximum pressure of the pressure stabilization chamber flows into the second chamber by pushing both the plunger and the blocking member away from the passageway so that the pressurized air further flows through an annular gap between the plunger and an inner surface of the second chamber, and the exit tunnel for exit.

The above and other objects, features and advantages of the invention will become apparent from the following detailed description taken with the accompanying drawings.

DETAILED DESCRIPTION OF THE INVENTION

Figure 1:
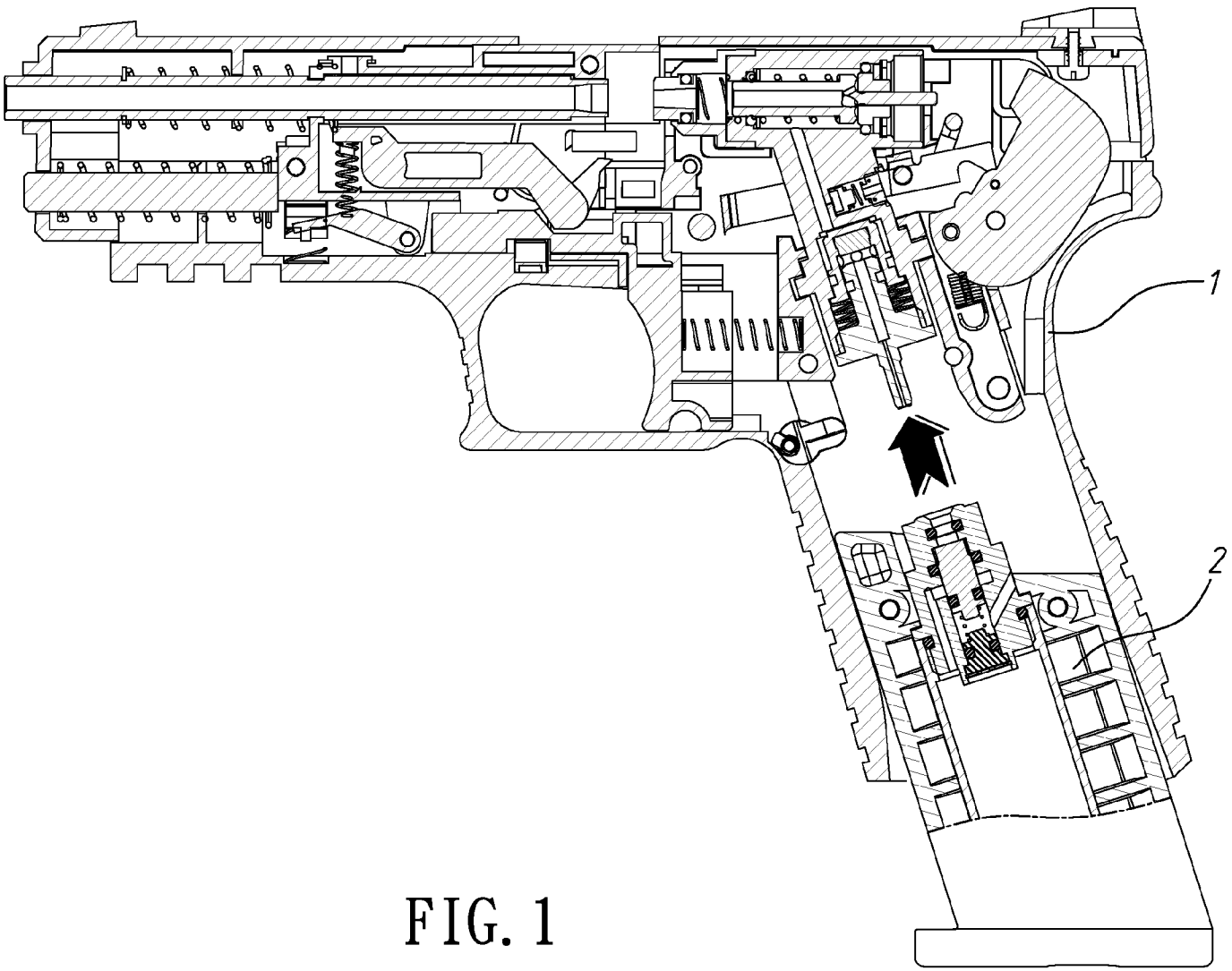
FIG. 1 is a longitudinal sectional view of an air pistol according to the invention with a gas cartridge to be attached to a connector.
Figure 2:
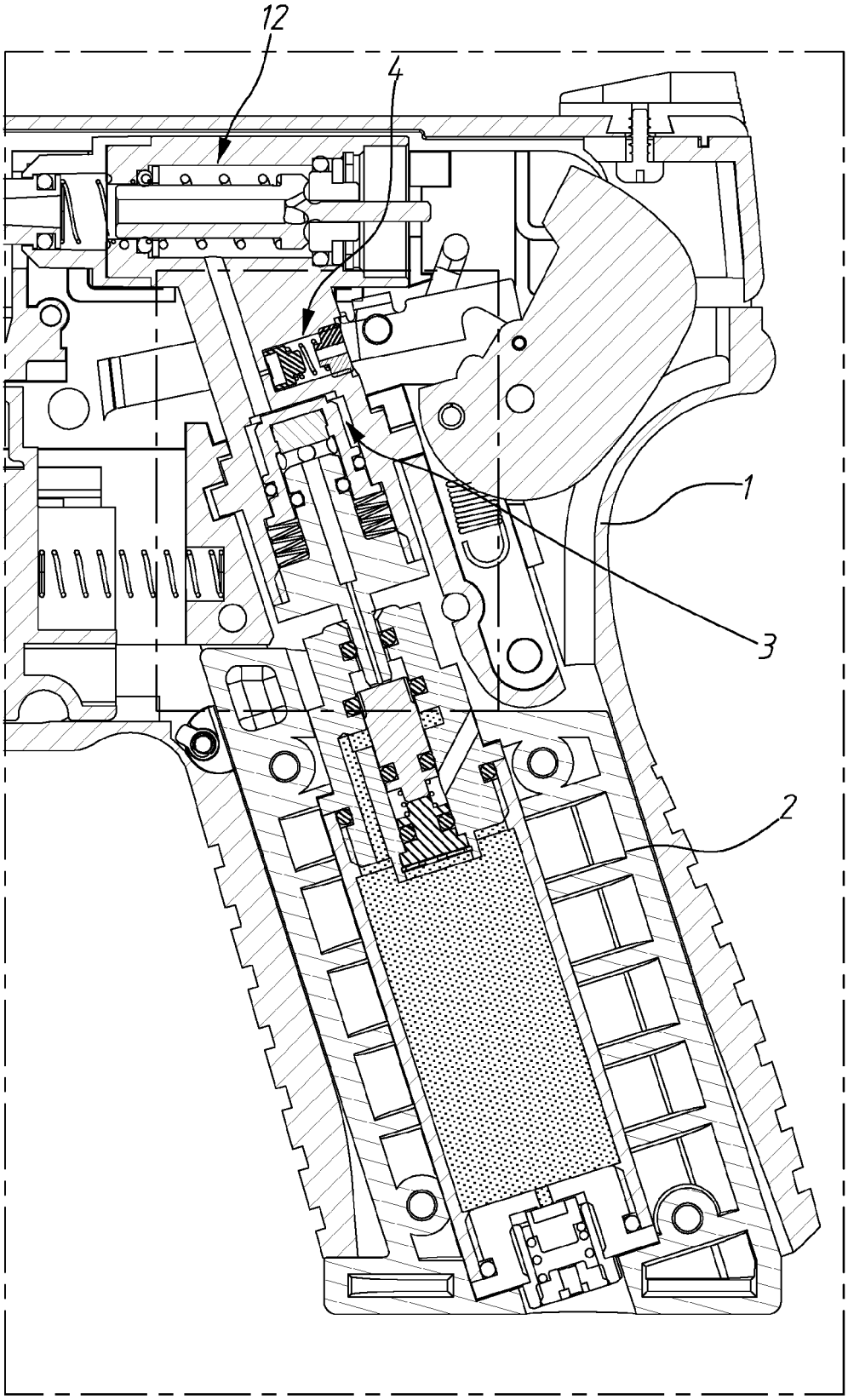
FIG. 2 is an enlarged view of the rear portion of the air pistol with the gas cartridge attached to the connector.
Figure 3:
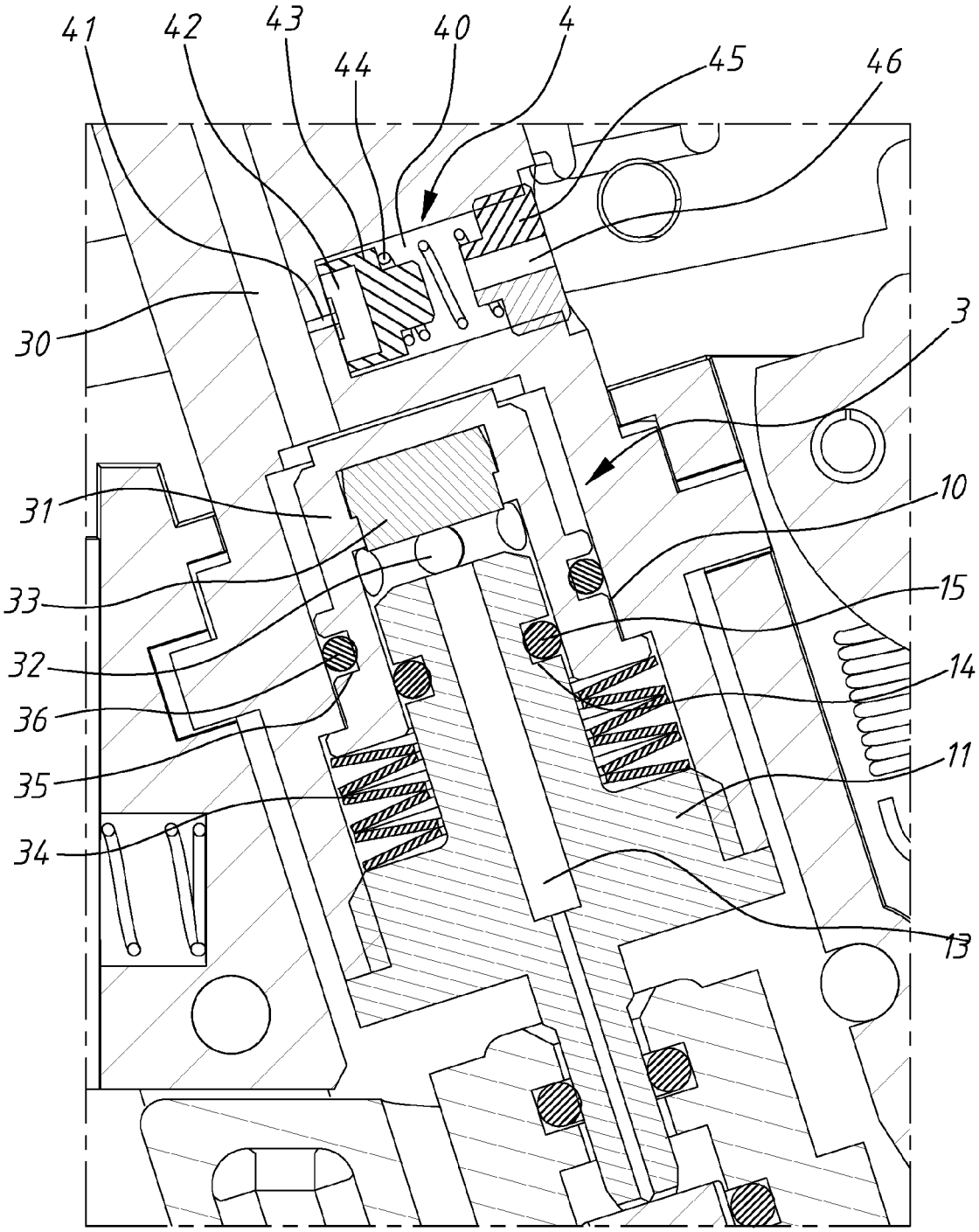
FIG. 3 is a detailed view of the area in a rectangle of FIG. 2.
Figure 4:
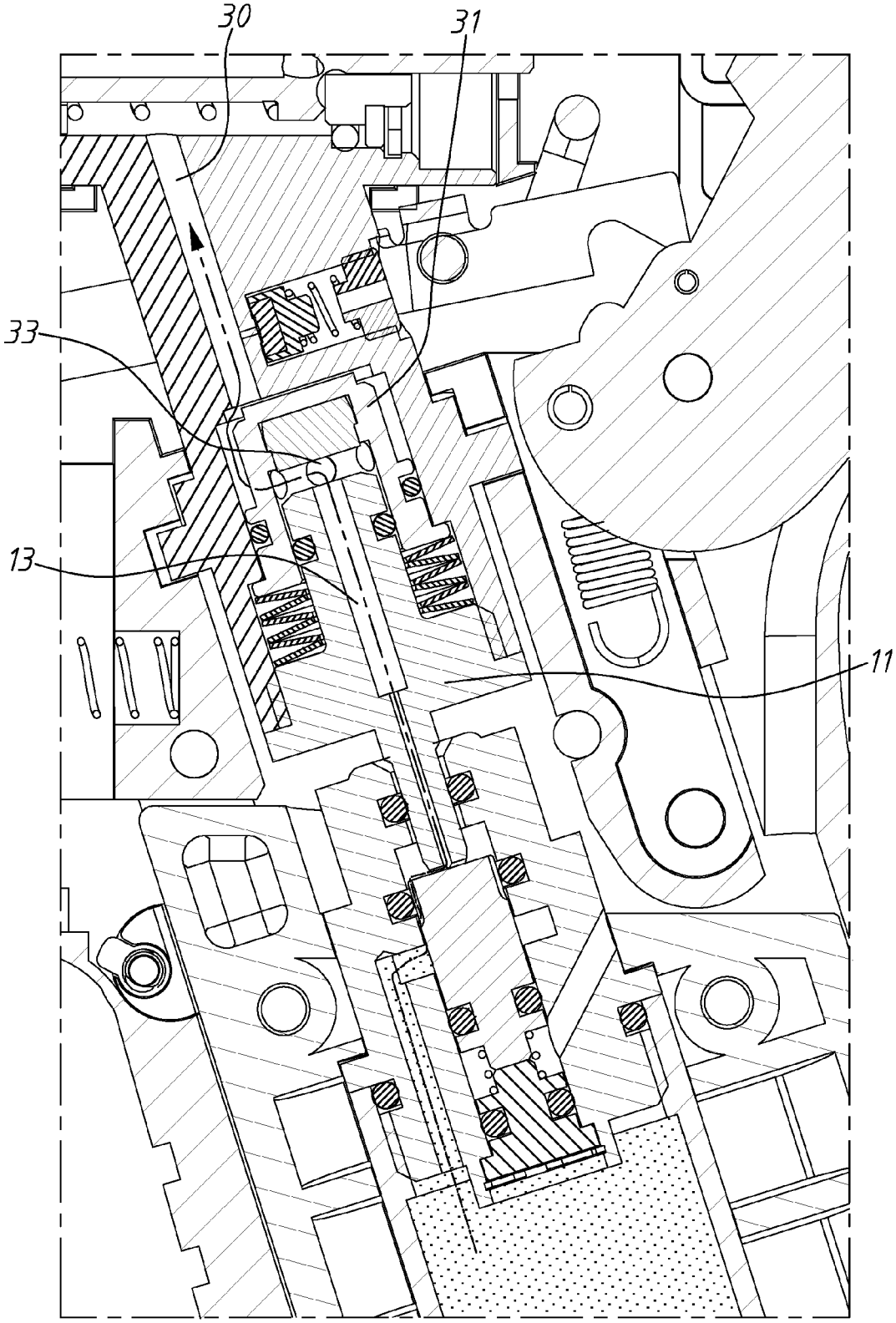
FIG. 4 is a view similar to FIG. 3 showing an air path from the gas cartridge to the pressure stabilization chamber for firing.

Referring to FIGS. 1 to 8, an air pistol 1 in accordance with the invention comprises the following components as discussed in detail below.

A gas cartridge 2 is filled with high pressure. A hollow connector 11 is provided on an upper portion of a hollow butt of the air pistol 1 and has a channel 13 through both ends. A pressure stabilization assembly 3 and a relief valve 4 are mounted further away from the butt than the connector 11. The connector 11 is provided in a chamber 10 and releasably secured to the gas cartridge 2 for communicating therewith. A pressure stabilization chamber 30 is provided between the connector 11 and a trigger 12. A cup 31 is provided in the chamber 10 with the connector 11 partially disposed therein. A sealing member 33 is provided on a bottom of the cup 31. A plurality of outlets 32 are provided between the sealing member 33 and the connector 11. A spring member 34 is provided between the cup 31 and the connector 11.

The relief valve 4 is provided in a chamber 40 spaced from the chamber 10. A passageway 41 communicates the pressure stabilization chamber 30 with one end of the chamber 40. A plunger 43 is provided in the chamber 40 adjacent to the passageway 41. A blocking member 42 is fastened in the plunger 43 and is proximate to one end of the chamber 40. A pressure adjustment screw 45 is provided at the other end of the chamber 40. A torsion spring 44 is put on both the plunger 43 and the pressure adjustment screw 45. An exit tunnel 46 is provided through the pressure adjustment screw 45 to communicate with the chamber 40.

An annular groove 14 is provided on the connector 11 and an O-ring 15 is disposed in the groove 14. An annular groove 35 is provided on the cup 31 and an O-ring 36 is disposed in the groove 35. The provisions of the O-rings 15, 36 are for preventing air from leaking.

A safe maximum pressure of the gas cartridge 2 is 3,000 psi. Pressurized air having a pressure greater than the maximum pressure may flow from a valve (not numbered) at bottom of the gas cartridge 2 out of the gas cartridge 2.

Pressurized air in the gas cartridge 2 having a pressure value no more than 3,000 psi may flow to the pressure stabilization chamber 30 via the channel 13 of the connector 11, the outlets 32, and the chamber 10. An activation of the trigger 12 may completely release pressure in the pressure stabilization chamber 30 at the end of firing (see FIG. 4).

Figure 5:
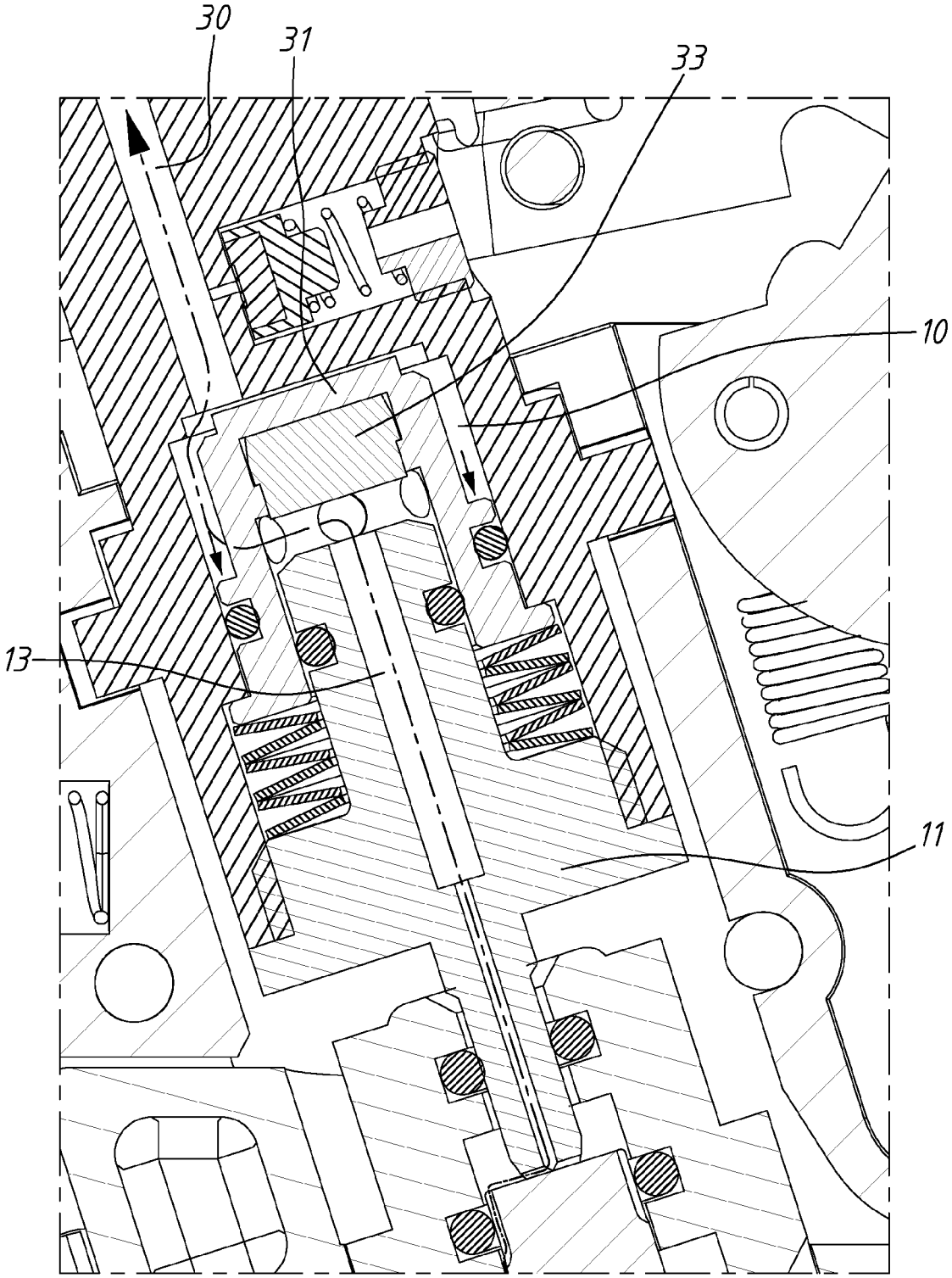
FIGS. 5 and 6 similar to FIG. 4 but showing air flowing back from the pressure stabilization chamber to the chamber to push the cup toward the connector with the spring member being compressed when pressure in the pressure stabilization chamber is greater than that in the chamber during the firing.
Figure 6:
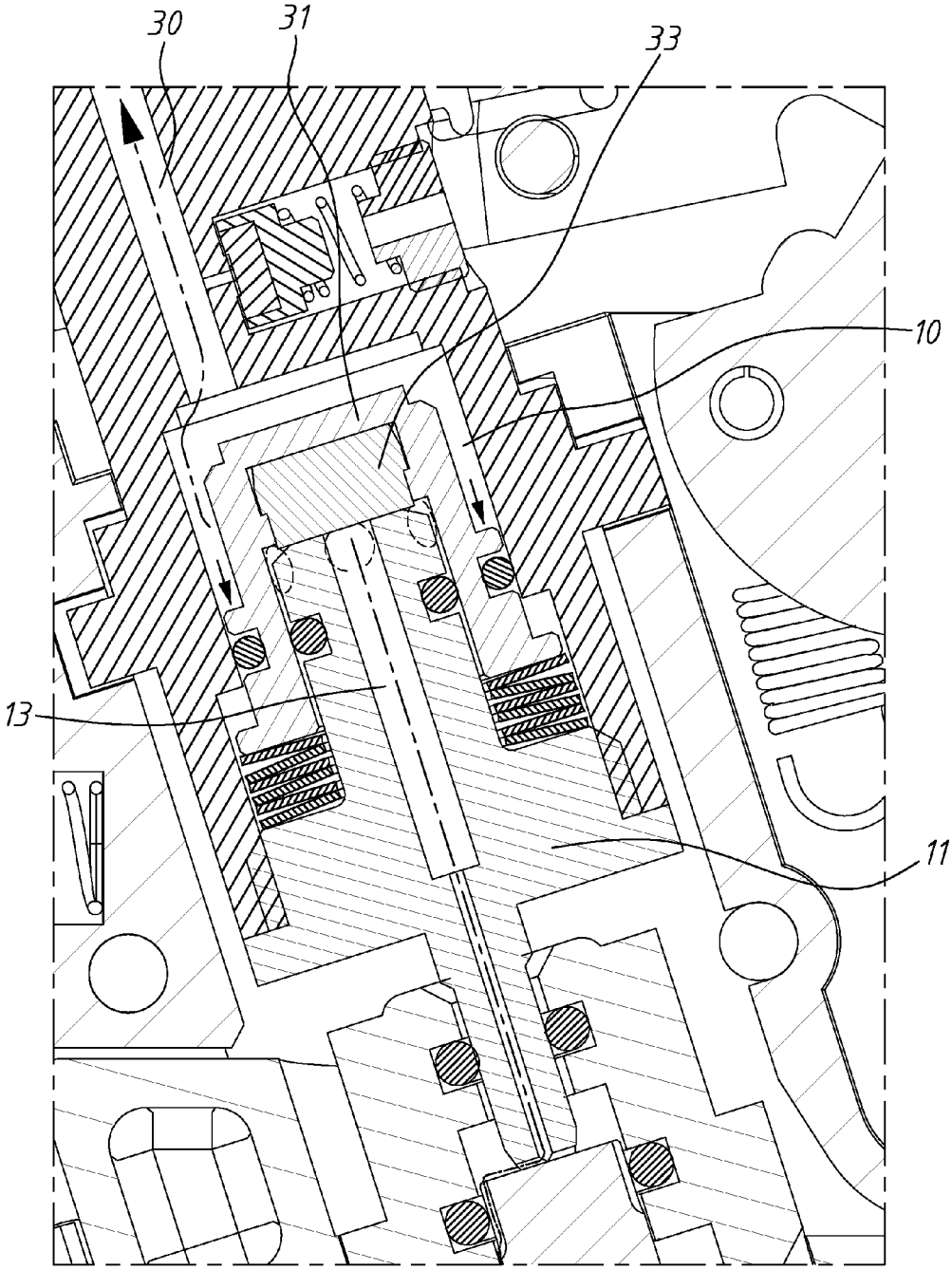

As shown in FIGS. 5 and 6, air may flow back from the pressure stabilization chamber 30 to the chamber 10 to push the cup 31 toward the connector 11 with the spring member 34 being compressed if pressure in the pressure stabilization chamber 30 is greater than that in the chamber 10 during the firing.

Figure 7:
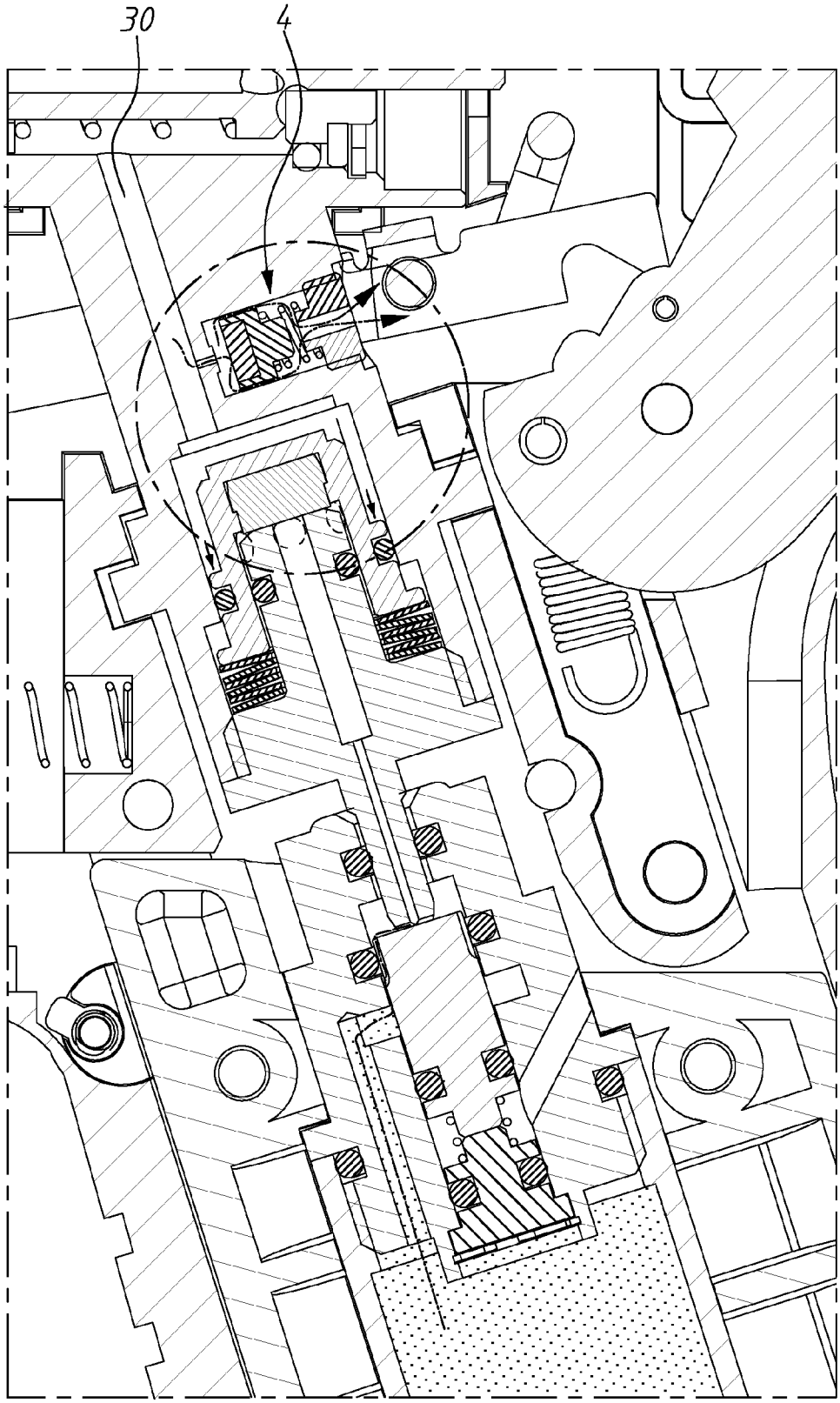
FIG. 7 is a view similar to FIG. 6 showing air having a pressure greater than the maximum pressure in the pressure stabilization chamber flowing into the chamber by pushing both the plunger and the blocking member away from the passageway so that excess air flows through an annular gap between the plunger and an inner surface of the chamber, and the exit tunnel for release.
Figure 8:
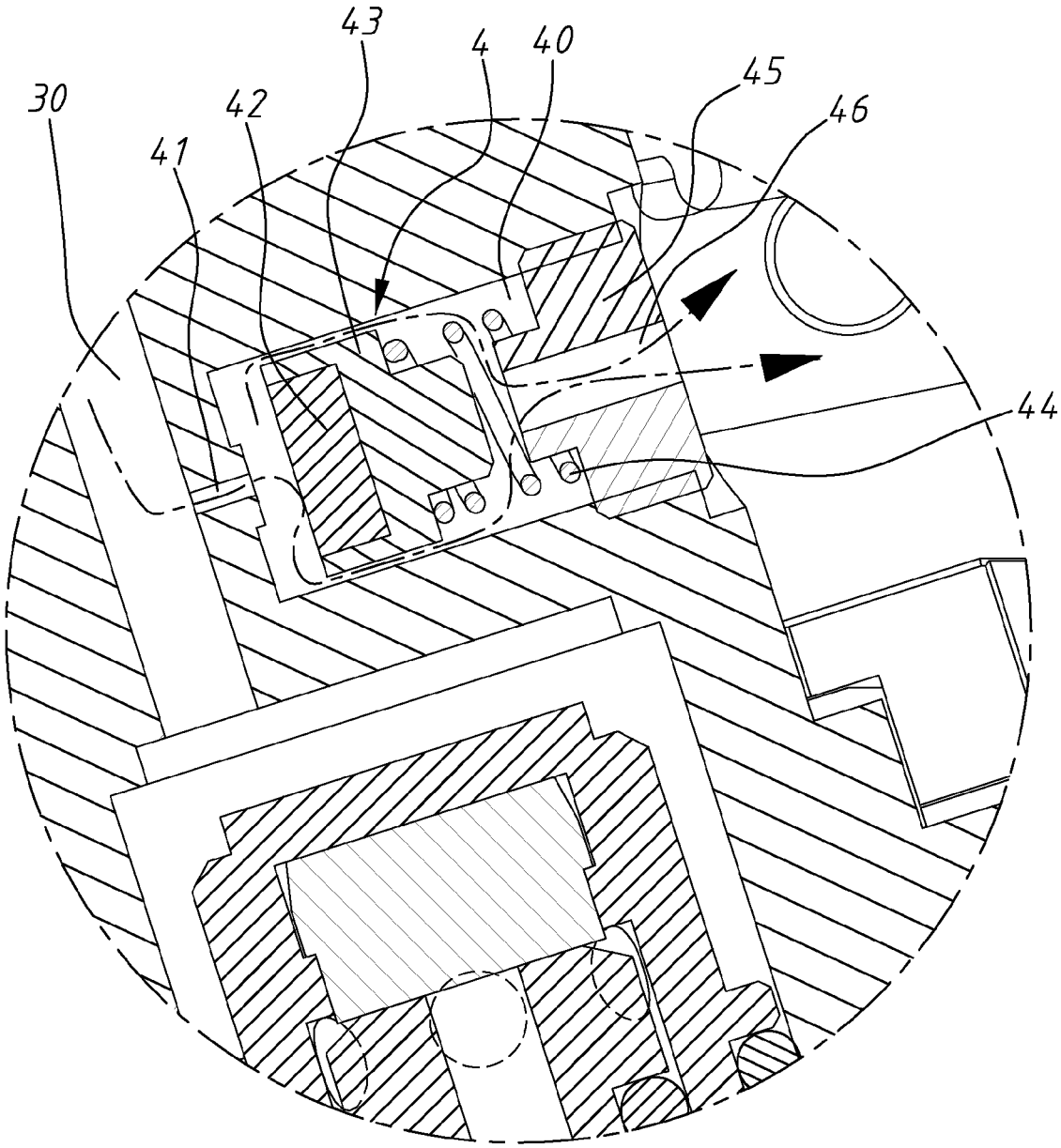
FIG. 8 is a detailed view of the area in FIG. 7.

A safe maximum pressure of the pressure stabilization chamber 30 is 800 psi. As shown in FIGS. 7 and 8, pressurized air having a pressure greater than the maximum pressure in the pressure stabilization chamber 30 may flow into the chamber 40 by pushing the plunger 43 (i.e., the blocking member 42) away from the passageway 41. And in turn, the excess air flows through an annular gap between the plunger 43 and an inner surface of the chamber 40, and the exit tunnel 46 for release.

While the invention has been described in terms of preferred embodiments, those skilled in the art will recognize that the invention can be practiced with modifications within the spirit and scope of the appended claims.

What is claimed is:

1. An air pistol comprising:

a trigger;

a gas cartridge;

a hollow connector disposed in a first chamber and releasably secured to the gas cartridge, the connector comprising an axial channel;

a pressure stabilization assembly comprising a pressure stabilization chamber disposed between the connector and the trigger, a spring biased cup disposed in the first chamber, a sealing member disposed on a bottom of the cup, and a plurality of outlets disposed between the sealing member and the connector; and a relief valve disposed in a second chamber spaced from the first chamber and comprising a passageway communicating the pressure stabilization chamber with one end of the second chamber, a spring biased plunger disposed in the second chamber adjacent to the passageway, a blocking member fastened in the plunger and proximate to one end of the second chamber, a pressure adjustment screw disposed at the other end of the second chamber, and an exit tunnel disposed through the pressure adjustment screw to communicate with the second chamber;

wherein pressurized air in the gas cartridge having a pressure no more than a predetermined maximum pressure of the gas cartridge flows to the pressure stabilization chamber via the channel of the connector, the outlets, and the first chamber; and wherein pressurized air in the pressure stabilization chamber having a pressure greater than a predetermined maximum pressure of the pressure stabilization chamber flows into the second chamber by pushing both the plunger and the blocking member away from the passageway so that the pressurized air further flows through an annular gap between the plunger and an inner surface of the second chamber, and the exit tunnel for exit.

* * * * *